United States Patent [19]

Sabatella et al.

[11] Patent Number: 4,778,959

[45] Date of Patent: Oct. 18, 1988

[54] FUSED DISCONNECT SWITCH

[75] Inventors: Robert J. Sabatella, Southington; John A. Morby, Farmington; Thomas A. Yazvac, Simsbury, all of Conn.

[73] Assignee: General Electric Company, New York, N.Y.

[21] Appl. No.: 42,763

[22] Filed: Apr. 27, 1987

[51] Int. Cl.[4] ..... H01H 33/08

[52] U.S. Cl. ..... 200/144 R; 200/162; 200/67 A

[58] Field of Search ..... 200/144 R, 162, 67 A

[56] References Cited

U.S. PATENT DOCUMENTS

| | | | |
|---|---|---|---|
| 1,393,111 | 11/1921 | Getchell | 200/67 A |
| 1,637,461 | 8/1927 | Wells | 200/67 A |
| 3,202,775 | 8/1965 | Tillson | 200/162 |
| 3,632,935 | 1/1972 | Stegmaier | 200/155 |
| 3,917,920 | 11/1975 | Pekrul et al. | 200/162 |
| 4,302,643 | 11/1981 | Cox et al. | 200/144 R |

*Primary Examiner*—Robert S. Macon

*Attorney, Agent, or Firm*—Richard A. Menelly; Walter C. Bernkopf; Fred Jacob

[57] ABSTRACT

A fused disconnect switch within a metal enclosure provides rapid connection line and load stabs with a minimum degree of arcing. The operating handle is arranged within the switch enclosure and is accessed by means of an operating handle extension. The operating handle mechanism is isolated from the electrical components within the enclosure.

9 Claims, 6 Drawing Sheets

FUSED DISCONNECT SWITCH

BACKGROUND OF THE INVENTION

Fused electric switches, as currently available, are rated electrically making and breaking connections within an electric circuit. A line stab connector and a load stab connector are opposedly arranged between a rotary driven pair of contact blades driven by an overcenter spring between open and closed positions. One example of an efficient fused electric switch is found within U.S. Pat. No. 3,917,920, entitled "Manually Operated Rotary Switch In Combination Load Contact-Fuse Therefore" and earlier U.S. Pat. No. 3,632,935, entitled "Double Blade Rotor Switch With Blades Insertable Into Rotatable Shaft", describes the arrangement of the contact blades within the rotor-operator. Both of the aforementioned patents are incorporated herein for reference purposes.

When state-of-the-art fused switches are employed within circuits above a nominal rating, arcing often occurs when the switch is rotated from its "OFF" to its "ON" position with the load terminals energized. A pair of opposing arc chutes facing the contact blades, ensures that the arc will be rapidly extinguished without damaging the contact material or overheating the switch interior. When an attempt is made to increase the switch rating, by correspondingly increasing the current-carrying switch components, it is found that the arc which occurs when the contact blades are rotated between their "closed" and "open" positions remains intense not withstanding the increased size of the current-carrying components.

One purpose of the instant invention is to provide a fused electric switch having increased ampere rating without damaging the switch components when the contact blades are rotated between their "closed" and "open" positions.

SUMMARY OF THE INVENTION

The invention comprises a fused disconnect switch having a rotary contact blade arranged between a pair of line terminal and load terminal stab connectors. The switch is driven between its "ON" and "OFF" positions by means of an overcenter spring controlled by an externally accessible operating handle. A contact delay spring is arranged to refrain movement of the blade operator until the mechanism spring has reached its overcenter position. The operating handle actuator components are mounted within the switch enclosure and are isolated from the contact arc.

DESCRIPTION OF THE PREFERRED EMBODIMENT

Figure 1:
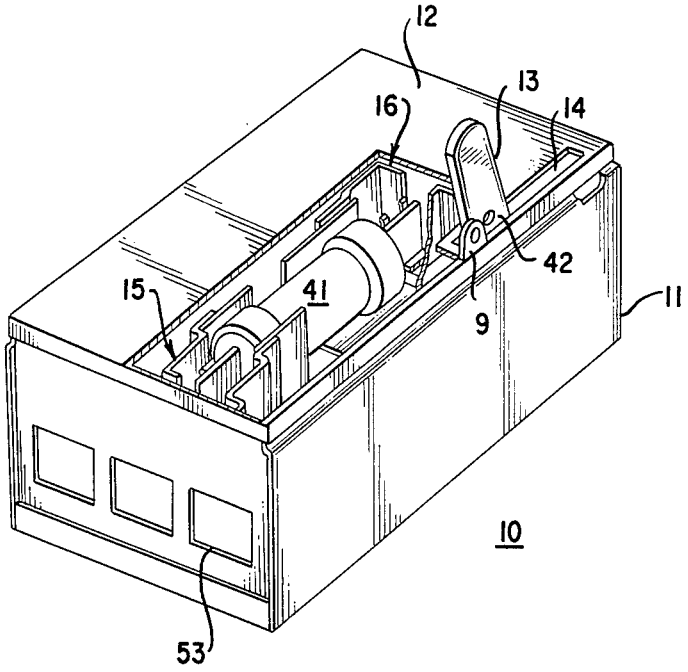
FIG. 1 a top perspective view of the fused switch accord to the invention.

A fused switch 10, similar to that described in aforementioned U.S. Pat. No. 3,917,920, is shown in FIG. 1 and consists of a stamped metal case 11 with a metal cover 12 hingeably attached at one end. An operating handle 13 extends through an elongated slot 14 through the cover and is provided with a padlock hole 42 and hasp 9 for locking the switch in either a "closed" or an "open" position. The interior of the switch includes a load base assembly, generally depicted at 15, to which the switch base assembly 16 is connected by means of three cartridge fuses 41, one of which is shown in phantom. Wiring access openings 53 allow for external electrical connection.

Figure 2:
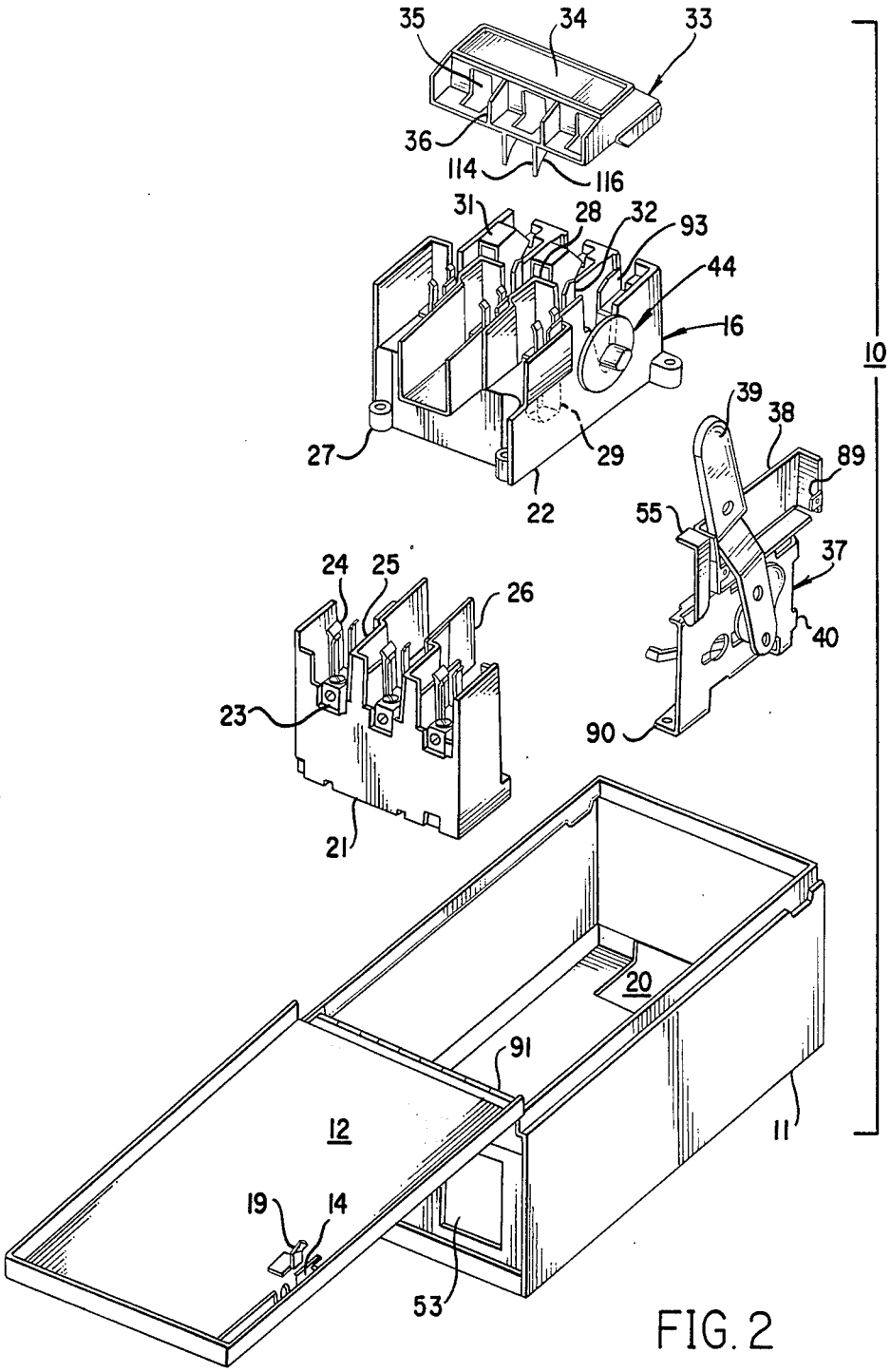
FIG. 2 s a top perspective view of the switch of FIG. 1 with the switch components in isometric projection from the switch enclosure.

The assembly of the switch components can be seen by referring now to FIG. 2 wherein the load base assembly is shown to consist of a molded plastic base 21 having four upstanding barriers 25 integrally formed therein and supporting three load terminal lugs 23 to which the load fuse clips 24 are attached. Insulating extensions 26 are used for interphasal installation for the fuses when connected with the corresponding load fuse clips 24 mounted on the switch base assembly 16. The switch base assembly is formed from a molded plastic base 22, which also has upstanding barriers 28 integrally formed therein, along with connection dogs 27, which allow for attachment between the base and the case 11 when inserted therein. The switch base assembly includes a rotor assembly 44 similar to that described in aforementioned U.S. Pat. No. 3,917,920 wherein three contact blades 32 are arranged for rotation between load side arc chutes 29 and line side arc chutes 31 as indicated. An arc chute cover 33 is arranged over the line side arc chutes 31 such that the three arc chutes seat within access slots 35 integrally formed within the arc chute cover and are isolated from the interior of the switch by means of a top 34 ad isolated from each other by means of interphasal baffles 36 integrally formed therein. A pair of downwardly extending baffles 114 provide dielectric isolation between the individual contact blades 32. The bottom of the downwardly extending baffles are shaped to define a radial slot 116 to seat on the shaft 51 formed on the rotor assembly 44, shown in FIG. 5. The arc chute cover 33 is fabricated from an ablative plastic material which is transparent to allow for a substantial amount of the arc energy to be transmitted in the form of light and to substantially reduce the temperature within the arc chute during arc formation therein and to also allow direct visual access to the condition of the contact blades. The ablative properties of the plastic material allow for a relatively transmissive surface upon repeated arcing occurrences. The actuator assembly 37 is mounted on a handle support frame 40 to which the operating handle 39 is pivotally mounted and which also supports an interlock lever 55 as indicated. To prevent the egression of the hard gaseous by-products generated during the arcing occurrence from exiting through the handle slot 14, an isolation baffle 38 is attached to the top of the handle support frame 40. The provision of the isolation baffle 38 allows the entire actuator assembly 37 to be mounted within the interior of the switch by attaching the actuator assembly to the side of the case 11 by means of brackets 89 and to the bottom of the case by means of the brackets 90 formed on the bottom of the handle support frame 40. Electrical connection between the three phase bus bars within the electric circuit, such as depicted at 87 in FIG. 7 and the line terminal stabs 93 on the switch base assembly 16, is made by means of the bus attachment slot 20 formed in the bottom of the case. Electrical connection with the load terminal lugs 23 is made by three wiring access openings 53 formed in one end of the case, as best seen in FIG. 1. The cover 12 is pivotally attached to the case by means of a piano hinge 91 which extends along the end of the case. A detent latch 19 is welded to the interior surface of the cover next to the handle slot 14 for interacting with the interlock lever 55 mounted on the actuator assembly 40.

Figure 3:
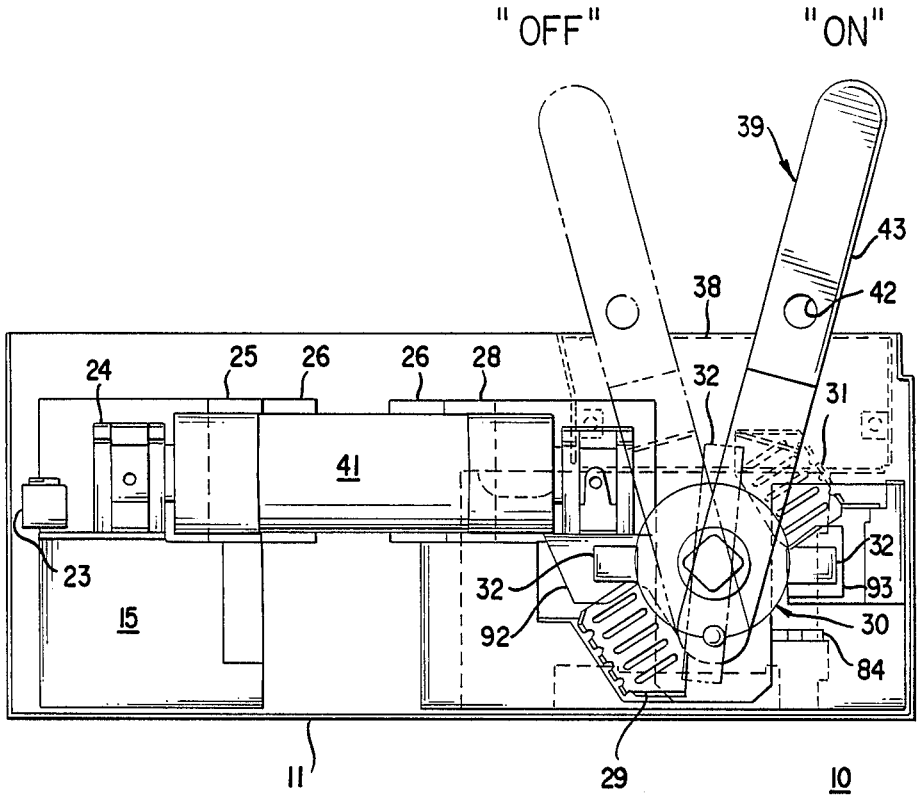
FIG. 3 is a side view of the switch of FIG. 1 with the operating handle depicted in its "open" and "closed" positions.

The operation of the switch between its "ON" and "OFF" position is seen by referring now to FIG. 3. The operating handle 39 is grasped by means of the insulative sleeve 43 arranged over the portion of the handle that extends outside the case 11 and the handle can be locked in its "ON" or "OFF" positions by means of a padlock (not shown) and by means of the padlock attachment hole 42 as described earlier. The bottom of the operating handle is attached to the mechanism assembly 30 in a manner to be discussed below in greater detail for rotating the opposing pair of contact blades 32 from between a pair of opposing load contact stabs 92 and line contact stabs 93 one of each of which is removed to show the location of the contact blades 32 relative to the operating handle 39. The load side arc chute 29 and the line side arc chute 31 deionize and cool the arcs that form during the separaton of the contact blades from the contact stabs when live connection is made with the line terminal strap 84 and the load terminal lugs 23. To disconnect between the line terminal strap and the load terminal lugs, the operating handle is rotated in a counterclockwise direction to now position the contact blades in their off position as indicated in phantom at 32'. The isolation baffle 38 confines the arc generated gases within the enclosure as will be described below in some detail. The barriers 28, 25 and insulative extensions 26 prevent electrical conduction between the fuses 41 that span between the fuse clips 24.

Figure 4:
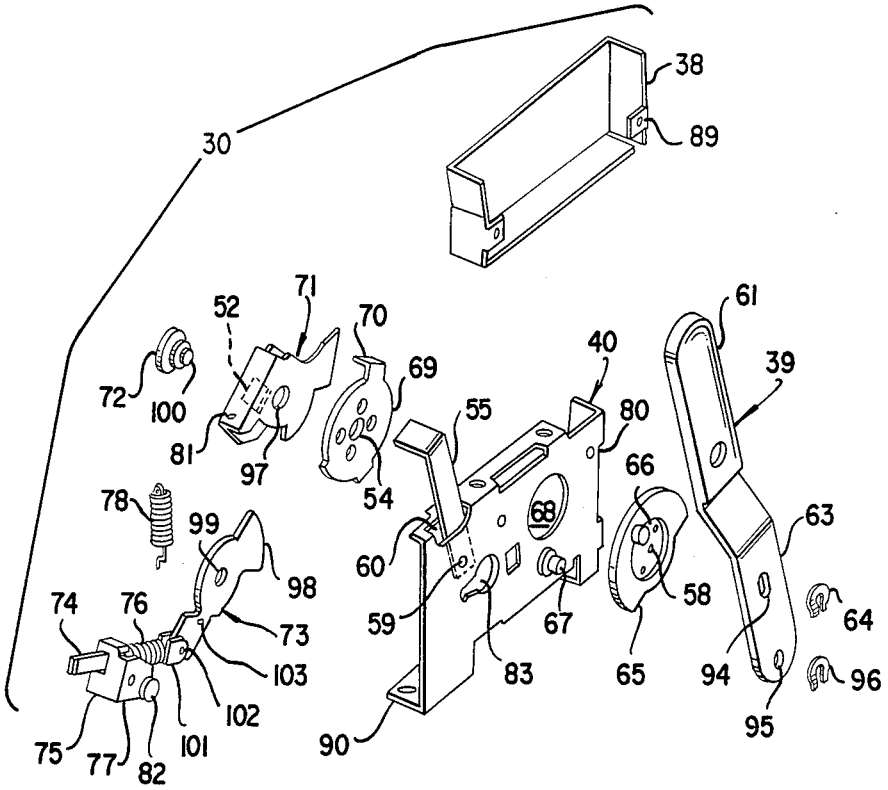
FIG. 4 is an enlarged side perspective view in isometric projection of the handle operator assembly shown in FIG. 2.

The mechanism assembly 30 is connected as shown in FIG. 4 by attaching the operating handle 39 which contains the handle grip 61 and the bottom offset extension 63 to the handle support frame 40 by positioning the handle drive 65 against the opening 68 formed in the support frame and inserting the pin 66 on the handle drive 65 through the slot 94 formed in the offset bottom of the handle in attaching a spring clip 64 over the pin 66. The pivot pin 67 extending from the handle support frame is passed through the handle slot 95 and is secured to the handle by means of a separate spring clip 96. The interlock lever 55 extends through a slot 60 formed within the top surface of the handle support frame and is pivotally attached to pivot pin 59 extending from the support frame. The rotor drive 71 which includes a shaft opening 52 for receiving the shaft 51 on the rotor assembly 44 (FIG. 5) is next attached to the handle support frame 40 by pre-positioning the disc drive unit 69 on the opposite face of the opening 68 in the handle support frame and inserting the cam portion 98 of the actuator 73 against the disc drive 69 and by next placing the rotor drive 71 against the cam portion. The rivet 72 holds the entire assembly together by insertion through the opening 97 in the rotor drive 71, the opening 99 in the cam portion 98 of the actuator 73, the opening 54 in the disc drive 69, the opening 68 in the handle support frame 40 and thence through the opening 58 in the handle drive 65 and forming over the rivet end 100 to securely fasten the components together. The actuator 73 is operatively attached to the handle support frame 40 by inserting a rivet 82 attached to the guide rod support 77 within the keyed slot 83 against the bias provided by the heavy mechanism spring 76 which extends between the yoke 101 formed at the bottom of the spring guide rod 74 and which is pivotally attached to the cam portion 98 by means of pin 102 and the guide rod support 77 through which the spring guide rod 74 extends via the spring guide slot 75 formed within the guide rod support 77. A contact delay spring 78 is connected between the rotor drive 71 and the actuator 73 by insertion of the spring ends within the holes 81 and 103 formed within the rotor drive 71 and the cam portion 98 respectively. As described earlier, the complete mechanism assembly 30 is attached to the case by means of brackets 89 formed within the isolation baffle 38 and the brackets 90 formed at the bottom of the handle support frame 40.

Figure 5:
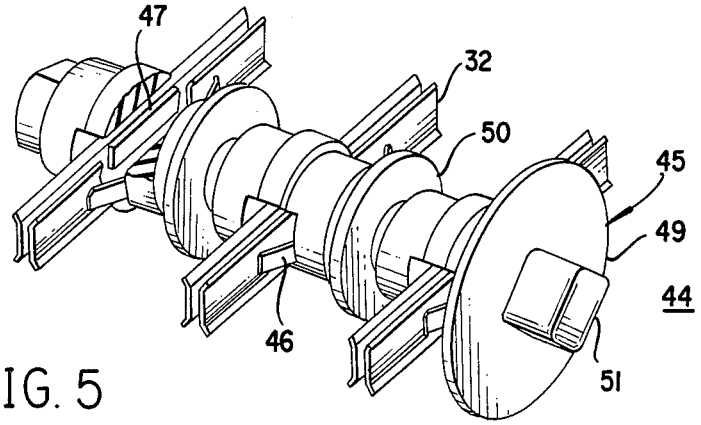
FIG. 5 is an enlarged top perspective view of the rotor assembly within the switch of FIG. 1.

The rotor assembly 44 is shown in FIG. 5 to consist of a unitary molded plastic rotor 45 formed into a large circular disc 49 from which the shaft 51 projects and two smaller discs 50 between which the contact blades 32 extend. The rotary assembly is described in U.S. Pat. No. 3,632,935 wherein the contact blades are indicated as bifurcated and are separated by a spacer 47. The two sides of the bifurcated blades are held together by opposing self aligning springs 46. This patent, entitled "Double Blade Rotor Switch With Blades Insertable Into A Rotatable Shaft" is incorporated herein for purposes of reference.

Figure 6A:
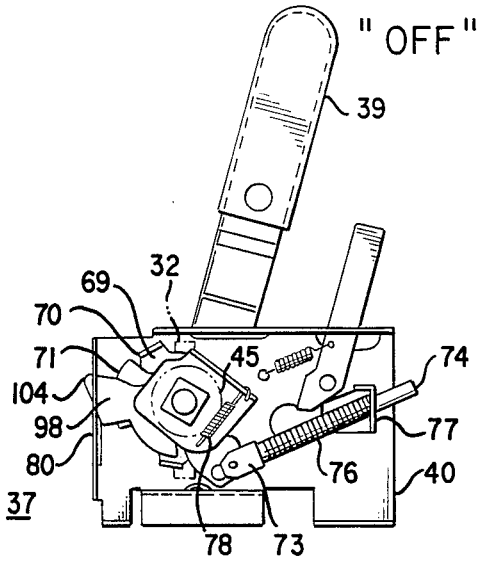
FIGS. 6A–6C are side views of the handle actuator assembly and rotor assembly of the switch of FIG. 1 depicting the operation of their components when the operating handle is moved from its "OFF" to "ON" positions.
Figure 6B:
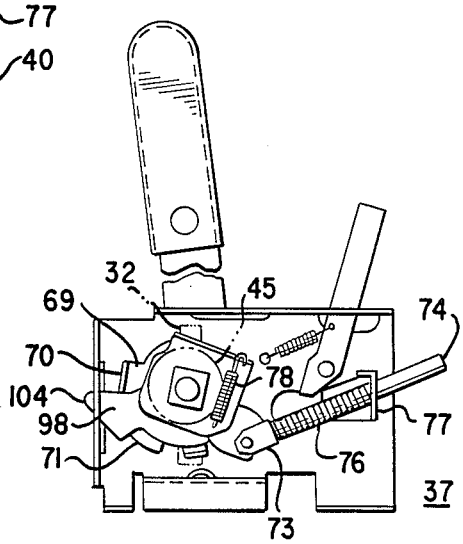
Figure 6C:
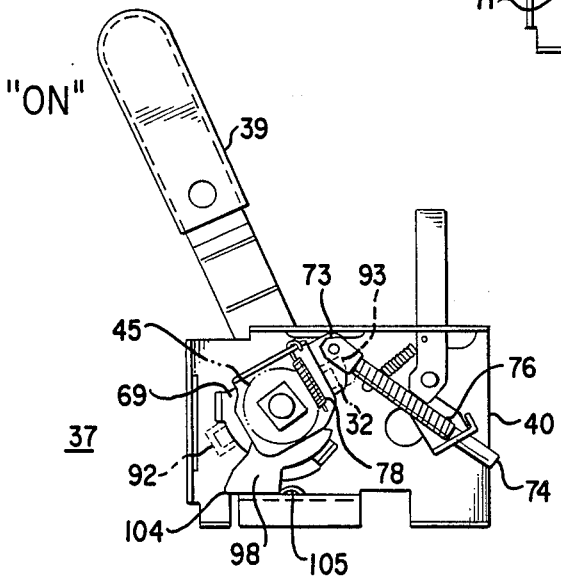

The function of the contact delay spring 78 can be seen by now referring to FIGS. 6A–6C wherein the operating handle 39 is first depicted in its off position with the unitary rotor 45 and the contact blades 32 indicated in phatom to show the travel of the unitary rotor and the contacts with respect to the counterclockwise rotation of the operating handle. The disc drive 69 and the rotor drive 71 are in the position indicated with the end 104 of the cam portion 98 stopped against the top surface of the slot 80 formed in the side of the handle support frame 40. In this position, the mechanism spring 76 holds the cam portion 98 of the actuator against the bent tab 70 extending from the disc drive 69 and the spring guide rod 74 extends a short distance beyond the guide rod support 77. The contact delay spring 78 is in its relaxed position between the rotor drive 71 and the actuator 73. Moving the handle operator 39 in the counterclockwise direction shown in FIG. 6B, forces the bent tab 70 on the disc drive 69 against the rotor drive 71 forcing the rotor drive 71 to rotate in the counterclockwise direction and drives the guide rod support 77 in the indicated direction compressing the mechanism spring 76 and extending the spring guide rod 74 a greater distance from the guide rod support 77. The contact delay spring 78 extends and holds the rotor 45 and the attached contact blades 32 in the same position indicated in FIG. 6B until the mechanism spring 76 overcenters driving the spring rod 74 in a clockwise direction and the guide rod support 77 to the position shown in FIG. 6C thereby rotating the rotor 45 in the counterclockwise direction to drive the contact blades 32 into electrical connection with the corresponding line and load stabs 93, 92. The cam portion 98 of the actuator 73 rapidly moves against a stop 105 formed in the bottom of the handle support frame 40. The tension of the contact delay spring 78 is adjusted to hold the rotor from rotation until such time as the operating handle 39 moves the mechanism spring 76 overcenter. This prevents the formation of an arc that would otherwise occur should the contact blades 32 be allowed to approach the load and line stabs 92, 93 when the switch is energized before the mechanism spring is overcenter.

Figure 7:
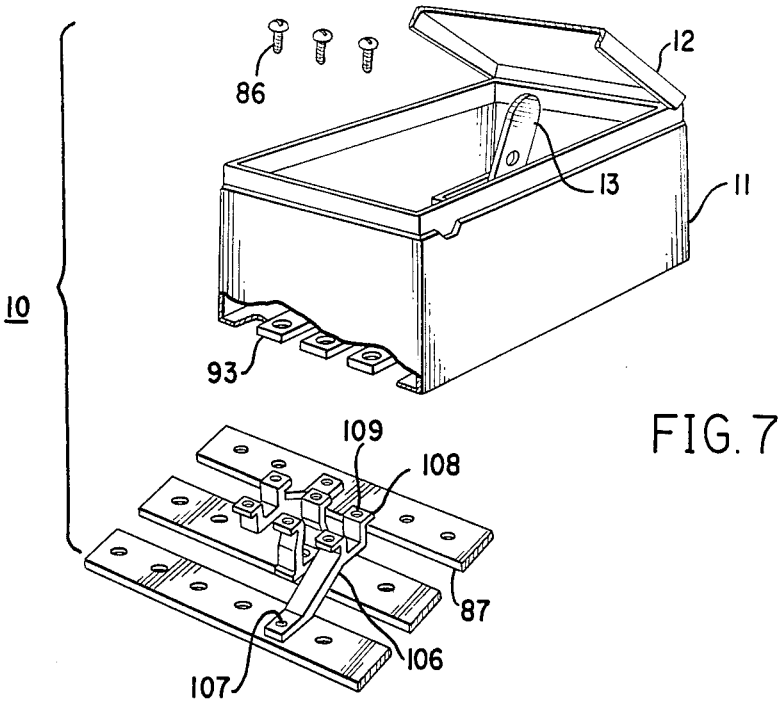
FIG. 7 is a top perspective view of the mounting arrangement of a bolt-on attachment of the switch of FIG. 1 with the main bus bars.
Figure 8:
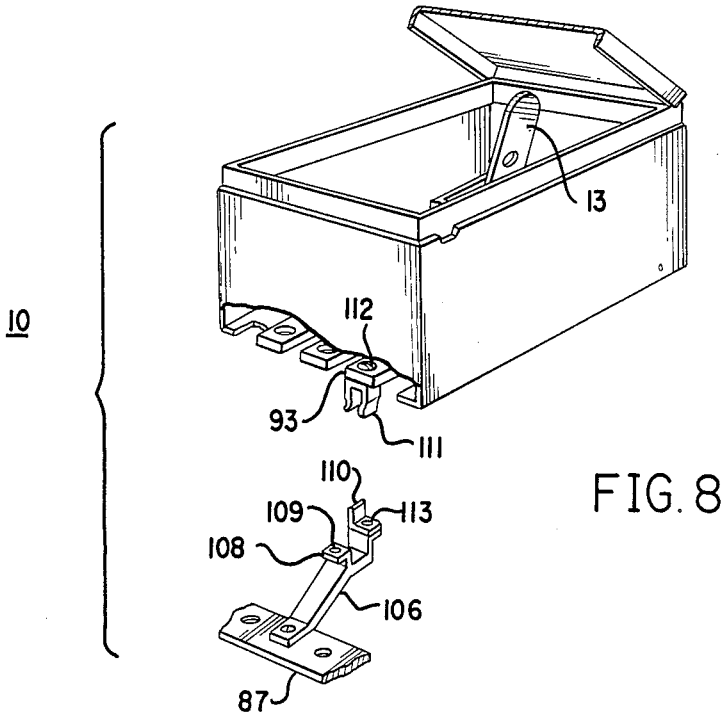
FIG. 8 is a top perspective view of the plug-on mounting arrangement of the switch of FIG. 1.

The attachment between the switch 10 and the power system bus bars 87 can be seen by referring now to FIGS. 7 and 8. The switch 10 is depicted with the cover 12 in its opened condition and with the elecrical components absent from inside the case 11. The operating handle 13 is depicted in its off position to insure that the line contact stabs 93 are not electrically connected with the remaining switch components. A separate branch strap adapter 106 is connected to each of the three bus bars 87 by means of holes 107 extending through one end of the adapter and a pair of contact surfaces 108 having threaded holes 109 formed therein are aligned under the switch line contact stabs 93 as indicated. The pair of contact surfaces 108 allow for the connection of two such switches 10 if desired to a single bus bar. The line contact stabs 93 are attached to the branch strap adapters 106 by means of bolts 86 engaging the threaded holes 109 formed within the contact surfaces 108. The arrangement depicted in FIG. 8 is for a "stab on" connection between the switch 10 and the bus bars 87. In this arrangement, a jaw or clip adapter 111 is attached to the underside of the line contact stabs 93 by means of a screw 112. A line strap stab adapter 110 is attached to the contact surfaces 108 on the branch strap adapter 106 by engaging a screw 113 with the threaded hole 109 formed within the contact surfaces 108. The branch strap adapters 106, line strap stab adapters 110 and jaw or clip adapters 111 can either be factory installed or supplied as a separate attachment kit for converting the switch from a bolt-on to a stab-on configuration at the installation site. The stab-on configuration allows the switch to be directly connected with the branch strap adapters without de-energizing the bus bars. When the switch is directly bolted to the branch strap adapters, the bus bars must be de-energized to prevent possible injury to the installer.

A fused switch has thus been described having means for allowing the operating handle to be mounted within the switch enclosure and further providing means for preventing movement of the rotatably mounted contact blades before a mechanism spring goes over center.

Having thus described our invention, what we claim as new and desire to secure by Letters Patent is:

1. A fused disconnect switch comprising:

a case and a cover;

a molded plastic load terminal assembly and a molded plastic switch assembly interconnected by at least one fuse and assembled within said case;

a rotary contact blade mechanism on said switch assembly arranged between line and load contact stabs and rotating a contact blade between line and load contact stabs to interrupt circuit current between corresponding line and load terminals on said switch assembly;

an actuator assembly within said case including a drive mechanism connecting between an operating handle and said contact blade mechanism thereby driving a contact blade on said contact blade mechanism under the bias of a mechanism spring; and a contact delay spring connecting between said drive mechanism and said contact blade mechanism to refrain rotation of said drive mechanism until said contact mechanism has moved to an overcenter position.

2. The fused disconnect switch of claim 1 including an access slot through said cover over said operating handle, a top part of said operating handle extending through said access slot.

3. The fused disconnect switch of claim 2 further including an isolation baffle intermediate said switch assembly and said handle thereby preventing gaseous materials generated during operation of said switch assembly from exiting through said access slot.

4. The fused disconnect switch of claim 1 including line and load arc chutes proximate said line and load contact stabs for quenching arcs which form when said contact blade is rotated in and out of contact with said line and load contact stabs.

5. The fused disconnect switch of claim 4 including a plastic arc chute cover over said line arc chutes, said arc chute cover including apertures providing egress of said gsseous materials and integrally formed baffles preventing electric conduction between said line contact stabs.

6. The fused disconnect switch of claim 4 wherein said line contact stabs include adapter means for electrically connecting with bus conductor stabs.

7. The fused disconnect switch of claim 6 wherein said adapter means comprises a formed metal clip.

8. The fused disconnect switch of claim 5 wherein said arc chute cover further includes integrally formed baffles preventing electric conduction between said contact blades.

9. The fused disconnect switch of claim 8 wherein said baffle means includes a radial slot seating on a radial shaft formed on said rotary contact blade mechanism.

* * * * *